US006978808B2

(12) United States Patent
Walsh et al.

(10) Patent No.: US 6,978,808 B2
(45) Date of Patent: Dec. 27, 2005

(54) BIAS-WOVEN SIDE CURTAIN AIRBAG

(75) Inventors: Robert V. Walsh, Peachtree City, GA (US); John Sollars, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 37 days.

(21) Appl. No.: 10/621,713

(22) Filed: Jul. 17, 2003

(65) Prior Publication Data

US 2005/0011578 A1 Jan. 20, 2005

(51) Int. Cl.[7] ..... D03D 41/00
(52) U.S. Cl. ..... 139/11; 139/383 R; 139/DIG. 1; 280/743.1; 280/735
(58) Field of Search ..... 139/383 R, 11, 139/DIG. 1; 280/743.1, 735

(56) References Cited

U.S. PATENT DOCUMENTS 5,533,755 A 7/1996 Nelsen et al.
6,220,309 B1 4/2001 Sollars, Jr.
6,293,584 B1 * 9/2001 Levine ..... 280/735
6,327,759 B1 * 12/2001 Keshavaraj et al. ..... 26/18.6
6,429,155 B1 8/2002 Li et al.
6,451,715 B2 9/2002 Li et al.
6,578,871 B2 * 6/2003 Gray et al. ..... 280/735
6,666,477 B1 * 12/2003 Robertson et al. ..... 280/743.1
6,676,155 B2 * 1/2004 Grosch et al. ..... 280/731
6,722,695 B2 * 4/2004 Kobayashi et al. ..... 280/739
6,728,616 B1 * 4/2004 Tabe ..... 701/45
6,729,650 B2 * 5/2004 Midorikawa et al. ..... 280/807
6,749,256 B1 * 6/2004 Klier et al. ..... 297/216.12
6,783,167 B2 * 8/2004 Bingle et al. ..... 296/76

* cited by examiner

*Primary Examiner*—John J. Calvert
*Assistant Examiner*—Robert H Muromoto
(74) *Attorney, Agent, or Firm*—Terry T. Moyer; John E. Vick, Jr.

(57) ABSTRACT

A method for making a side curtain airbag by weaving the airbag in a bias direction ranging from 20° to 70° with respect to the warp of the fabric of which the side curtain airbag is made in order to increase contraction of the bag upon inflation and to increase productivity of airbag manufacture. By orienting the airbag pattern on a bias, airbags can be better "nested" in the output of the loom, less material is wasted and high loom utilization achieved. The airbag is preferably made with a low-permeability weave to reduce leakage of inflation medium upon inflation of the airbag. In some applications, the major axis of the airbag is perpendicular to the warp.

13 Claims, 3 Drawing Sheets

BIAS-WOVEN SIDE CURTAIN AIRBAG

BACKGROUND OF THE INVENTION

The present invention relates to making inflatable protective cushions, and more specifically relates to the type of curtain cushion particularly useful in side protection of occupants in a transportation vehicle, such as an automotive vehicle, railroad, car, airplane, or the like.

Inflatable protective cushions used in passenger vehicles are a component of relatively complex passive restraint systems. The main elements of these systems are: an impact sensing system, an ignition system, a propellant material, an attachment device, a system enclosure, and an inflatable protective cushion. Upon sensing an impact, the propellant is ignited causing an explosive release of gases filling the cushion to a deployed state that can absorb the impact of the movement of a body against it and dissipate its energy by means of rapid venting of the gas. The entire sequence of events occurs within about 30 milliseconds.

A typical construction material for airbags has been a polyester or, nylon fabric, coated with an elastomer such as neoprene, or silicone. The fabric used in such bags is typically a woven fabric formed from synthetic yarn by weaving practices that are well known in the art. In the un-deployed state, the cushion is most commonly stored in or near the steering column, the dashboard, in a door panel, or in the back of a front seat placing the cushion in close proximity to the person or object it is to protect.

The use of a coating material has found acceptance because it acts as an impermeable barrier to the inflation medium. This inflation medium is generally a nitrogen or helium gas generated from a gas generator or inflator. Such gas is conveyed into the cushion at a relatively warm temperature. The coating obstructs the permeation of the fabric by such gas, thereby permitting the cushion to rapidly inflate without undue decompression during a collision event.

Airbags may also be formed from uncoated fabric that has been woven in a manner that creates a product possessing low permeability or from fabric that has undergone treatment such as calendaring to reduce permeability.

Silicone coatings typically use either solvent-based or complex, two-component reaction systems. Dry coating weights for silicone have been in the range of about 3 to 4 ounces per square yard or greater for both the front and back panels of side curtain airbags.

The majority of commercially used restraint cushions are formed of woven fabric materials utilizing multifilament synthetic yarns of materials such as polyester, nylon 6 or nylon 6,6 polymers.

The driver-side airbags are typically of a relatively simple configuration in that they function over a fairly small well-defined area between the driver and the steering column. One such configuration is disclosed in U.S. Pat. No. 5,533,755 to Nelsen et al., issued Jul. 9, 1996, the teachings of which are incorporated herein by reference. However, inflatable cushions for use in the protection of passengers against frontal or side impacts must generally have a more complex configuration since the position of a vehicle passenger may not be well defined and greater distance may exist between the passenger and the surface of the vehicle against which that passenger might be thrown in the event of a collision.

As will be appreciated, the permeability of a side cushion airbag structure is an important factor in determining the rate of inflation and subsequent rapid deflation following the impact event. In order to control the overall permeability of the cushion, it may be desirable to use differing materials in different regions of the cushion. Thus, the use of several fabric panels in construction of the cushion may prove to be a useful design feature. The use of multiple fabric panels in the cushion structure also permits the development of relatively complex three-dimensional geometries that may be of benefit in the formation of cushions for passenger side applications wherein a full-bodied cushion is desired. While the use of multiple fabric panels provides several advantages in terms of permeability manipulation and geometric design, the use of multiple fabric panels for use in passenger side restraint cushions has historically required the assembly of panels having multiple different geometries involving multiple curved seams.

Panel geometries that include curved seams-pose a problem for permeability. Curved seams tend to leak inflation medium to a greater degree than seams following or perpendicular to the warp of the fabric. Consequently, side curtain airbags are designed and oriented so that the longest straight seam is parallel to the warp of the fabric.

As will be appreciated, another important consideration in cutting panel structures from a base material is the ability to maximize the number of panels which can be cut from a fixed area through close-packed nesting of the panels. It has been found that minimizing the number of different geometries making up panels in the cushion and using geometries with substantially straight line perimeter configurations generally permits an enhanced number of panels to be cut from the base material with the least waste. The use of panels having generally straight-line profiles has the added benefit of permitting the panels to be attached to one another using substantially straight seams or to be substantially formed during the weaving process using a jacquard or dobby loom. For the purposes of this invention, the term "seam" is to be understood as any point of attachment between different fabric panels or different portions of the same fabric panel. Thus, a seam may be sewn (such as with thread), welded (such as by ultrasonic stitching), woven (such as on a jacquard or dobby loom, as merely examples), and the like. Substantially straight seam configurations thus provide more cost-effective methods of producing airbags.

Technology has been developed to improve the impermeability of curved seams. For example, see Sollars, Jr., in U.S. Pat. No. 6,220,309, issued Apr. 24, 2001, teaching an inflatable fabric comprising basket-woven attachment points between fabric panels; Li et al in U.S. Pat. No. 6,451,715, issued Sep. 17, 2002, teaching a low permeability side curtain airbag having extremely low coating levels; and Li et al, U.S. Pat. No. 6,429,155, issued Aug. 6, 2002, teaching low permeability airbag cushions having film coatings of extremely low thickness, all of which are incorporated herein by reference.

Side curtain airbags not only provide cushioning effects from impact but also provide protection from broken glass and other debris. They also help to restrain a passenger during vehicle roll over. Upon inflating, side curtain airbags tend to contract. Contraction increases tension and their ability to restrain passengers from lateral movement, and especially when the vehicle they occupy is rolling over with the windows open. As such, it is imperative that side curtain airbags, retain large amounts of gas, at high gas pressures, to provide restraint and cushioning throughout the longer time periods of the entire potential rollover situation, and contract as much as possible to provide the restraint needed to hold the passengers in the vehicle.

There is thus a need for a method of making a strongly contracting airbag that increases the number of airbags that can be made from a unit area of fabric while not significantly contributing to inflation medium leakage.

SUMMARY OF THE INVENTION

In view of the foregoing, it is an object of the invention to make improve the contraction of side curtain airbags upon inflations. It is a further object of the invention to make more airbags from a given unit of fabric. These objects may be achieved by providing an airbag having a longest straight side and a major axis, and then weaving a side curtain airbag fabric having a warp, with said longest straight side oriented in a bias direction with respect to said warp. The weaving of the airbag may be done in a bias direction between 20° and 70° using a weaving technique that provides a tighter seam, particularly for curved seams. A bias-woven side curtain airbag contracts more strongly than one that is not bias-woven.

One feature of this invention is the use of the Milliken weave in weaving airbags-on a bias. The use of this weaving technique offsets in part the potential for inflation medium leakage that inevitably results from the greater number of curved or bias-direction seams from the bias-weaving of the side curtain airbag pattern.

Another feature of the present invention is weaving airbags on a bias. By bias-weaving the airbags according to the Milliken weave, the choice of orientations of the airbag increases significantly from at most eight (combinations of horizontal or vertical, right-side-up or upside down, and front-side-forward or back-side-forward) to an infinite number. Thus, the user seeking to minimize wasted fabric has many more choices and can relatively easily improve fabric utilization by nesting the side curtain pattern within the available loom size that dictates loom output dimensions. With care, and perhaps computer assistance, the fabric utilization efficiency can be optimized.

One advantage of the present invention is that the resulting bias-woven side curtain airbags will tend to contract to a greater extent than airbags not woven on a bias, particularly at biases approaching 45°. Thus greater tension is obtained and greater restraint of passengers' results.

Still another advantage of the present invention is that the bias-woven airbag requires no changes in the airbag deployment system on account of its being bias-woven. Therefore, the bias-woven airbag can be implemented without undue delay, modifications, or complications.

It is to be understood that both the foregoing general description and the following detailed description are exemplary and explanatory only and are not restrictive of the invention, as claimed.

BRIEF DESCRIPTION OF THE DRAWINGS

The accompanying drawings which are incorporated in and constitute a part of this specification, serve to illustrate several preferred embodiments and practices according to the present invention and together with the description, serve to explain the principles of the invention wherein.

DESCRIPTION OF EMBODIMENTS

Reference will now be made in detail to potentially preferred embodiments and practices. It is, however, to be understood that reference to any such embodiments and practices is in no way intended to limit the invention thereto. On the contrary, it is intended by the applicants to cover all alternatives, modifications and equivalents as may be included within the spirit and scope of the invention as defined by the appended claims.

The present invention is a method for making side curtain airbags. For simplicity, the term "airbag" will be used for a cushion regardless of whether it is inflated with air, nitrogen, helium or other inflation medium. The method comprises orienting the airbag in a bias direction rather than with its longest straight side parallel or perpendicular to the warp of the fabric of which the airbag is to be made. In particular, the method comprises the step of weaving the airbag so that its longest straight side at an angle ranging between 20° and 70° from parallel with the warp of the airbag fabric.

As a result of the bias-weaving of the airbag, a greater percentage of its seams will track a bias direction. In order to reduce what would otherwise be a heightened potential for the bias-woven airbag to leak inflation medium more quickly upon inflation, the present method preferably includes a particular method for weaving the airbag, as will now be described, and, as noted above, will be referred to herein as the Milliken weave.

Figure 1:
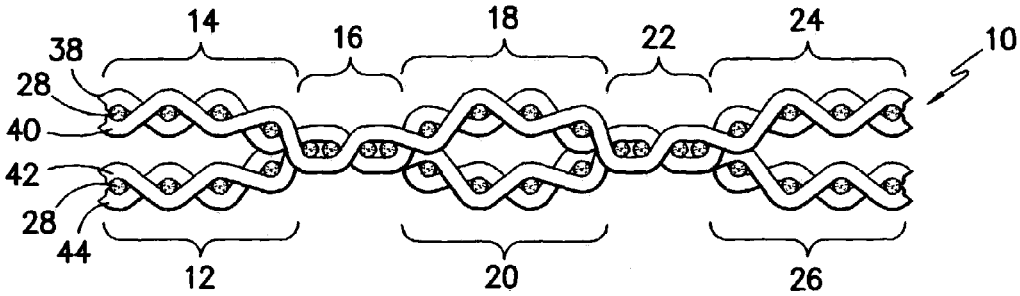
FIG. 1 is a cross-sectional view of an inventive all-woven inflatable fabric showing the preferred double and single layer areas including two separate single layers.

Turning now to the drawings, FIG. 1 shows a cross-section of a preferred structure for the double fabric layers 12, 14, 18, 20, 24, 26 and single fabric layers 16, 22 of the inventive inflatable fabric 10. Weft yarns 28 are present in each of these fabric layer areas 12, 14, 16, 18, 20, 22, 24, 26 over and under which individual warp yarns 38, 40, 42, 44 have been woven. The double fabric layers 12, 14, 18, 20, 24, 26 are woven in plain weave patterns. The single fabric layers 16, 22 are woven in basket weave patterns. Four weft yarns each are configured through each repeating basket weave pattern within this preferred structure; however, anywhere from two to twelve weft yarns may be utilized within these single fabric layer areas (seams) 16, 22. The intermediate double fabric layer areas 18, 20 each comprise only four weft yarns 28 within plain weave patterns. The number of such intermediate weft yarns 28 between the single fabric layer areas 16, 22 may be in multiples of two to provide the maximum pressure bearing benefits within the two seams 16, 22 and thus the lowest possibility of yarn shifting during inflation at the interfaces of the seams 16, 22 with the double fabric layer areas 12, 14, 24, 26.

Figure 2:
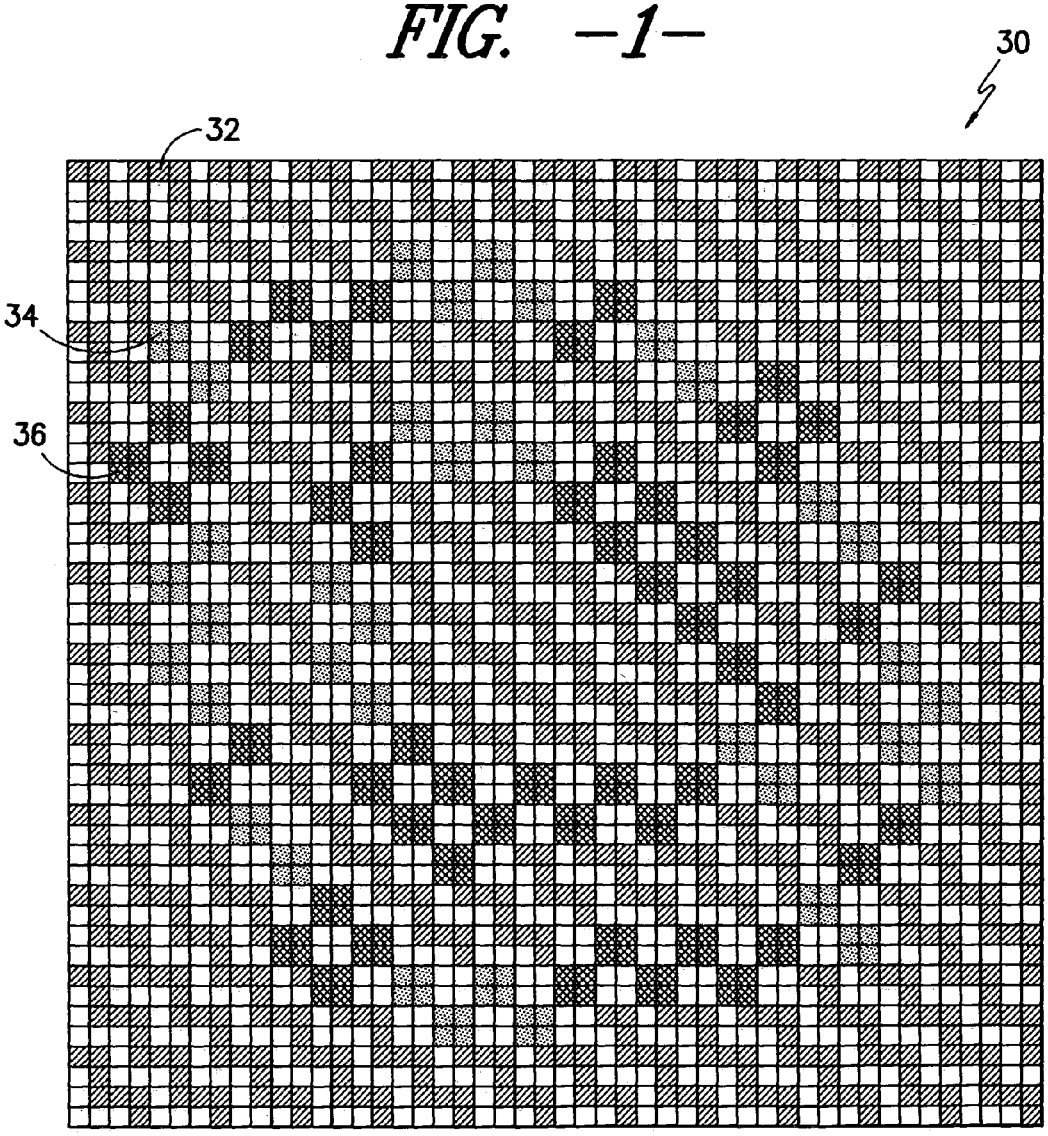
FIG. 2 is a weave diagram illustrating a potentially preferred repeating pick pattern formed using repeating plain weave and basket weave four-pick arrangements.

FIG. 2 shows the weave diagram 30 for an inventive fabric that comprises two Irregularly shapes concentric circles as the seams. Such a diagram also provides a general explanation as to the one type of selection criteria of placement of basket-weave patterns within the fabric itself. Three different types of patterns are noted on the diagram by different shades. The first 32 indicates the repeated plain weave pattern throughout the double fabric layers (12, 14, 18, 20, 24, 26 of FIG. 1, for example) which are at a location in the warp direction of 4X+1, with X representing the number of pick arrangement within the diagram, and at a location in the fill direction of 4X+1 (thus, the pick arrangement including the specific two-layer plain-weave-signifying-block 32 begins at the block four spaces below it in both directions). The second 34 indicates an "up-down" basket weave pattern wherein an empty block exists and initiates the basket-weave pattern at a location in the warp direction of 4X+1, With X representing the number of repeating pick arrangements within the diagram, and at a location in the fill direction of 4X+1, when a seam (such as 16 and 22 in FIG. 1) is desired (thus, the pattern including the pertinent signifying "up-down" block 34 includes an empty block within the basket-weave pick arrangement in both the warp and fill directions four spaces below it). The remaining pattern, which is basically a "down-up" basket weave pattern in a single fabric layer (such as 16 and 22 in FIG. 1), is indicated by shaded block 36. Such a pattern initiates at a location in the warp direction of 4X+1 and fill of 4X+3, or warp of 4X+3 and fill of 4X+1, when a seam is desired. Such a specific arrangement of differing "up-down" basket weave 34 and "down-up" basket weave 36 pattern effectuates the continuous and repeated weave construction wherein no more than three floats (i.e., empty blocks) are present simultaneously within the target fabric structure. This pattern is the same as that disclosed and discussed in U.S. Pat. No. 6,220,309.

Figure 3:
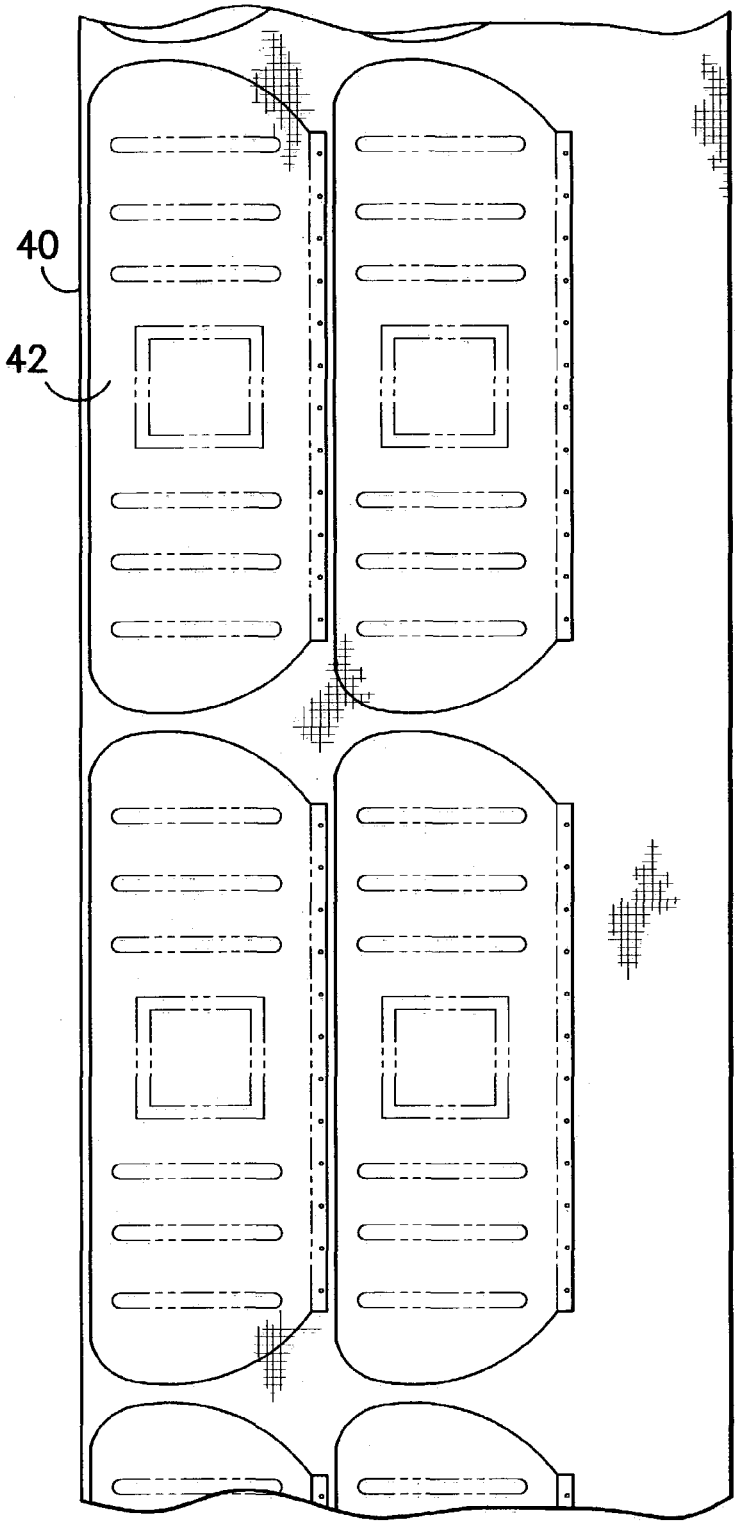
FIG. 3 illustrates a series of side curtain airbags being woven not on a bias.

FIG. 3 illustrates the output fabric 40 of a loom (not shown) being woven in which airbags 42 are not woven in a bias direction but, rather, with their longest straight side or major side parallel to the warp of the fabric. The warp of the fabric follows the run of the fabric, vertical in FIG. 3. Looms come in standard widths, which produce standard loom output widths, such as 62, 72 and 96 inches; airbags are not necessarily designed in these widths or lengths, nor are these widths necessarily exact multiples of the width of an airbag so that multiple airbags can be woven simultaneously and in parallel with little or no fabric waste. Because of the width of the output fabric 40 and the width of the airbag 42, two side-by-side airbags 42 are woven and either an excess 44 of wasted fabric is generated or a portion of the loom goes unused. In either case, productivity is lower than is otherwise desirable.

Figure 4:
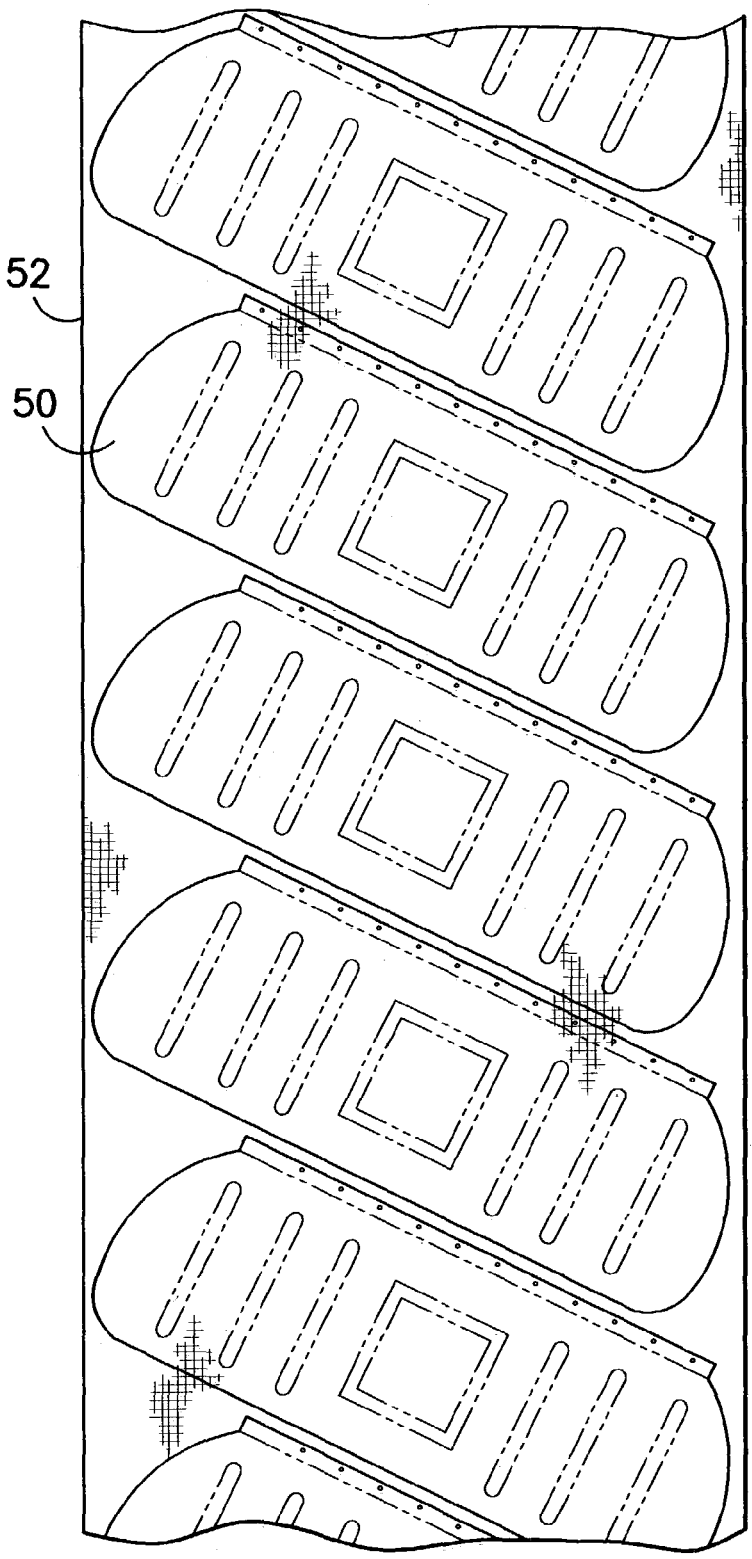
FIG. 4 illustrates the same side curtain airbags as illustrated in FIG. 3 being woven on a bias.

FIG. 4 illustrates the use of bias-weaving in improving productivity by increasing loom utilization or reducing fabric waste. Airbag 50, which has the same configuration and dimensions as airbag 40, is oriented at an angle with respect to the warp of output fabric 52; that is, its longest straight side is angled with respect to the warp of output fabric 52. Output fabric 52 has the same width as output fabric 40. As a result of the use of bias weaving, there is less wasted fabric or greater loom utilization.

For example, a 20-inch wide airbag would be woven in fabric that is 20, 40, 60, or 80 inches wide (plus selvage allowances), but a 21-inch airbag would require 21, 42, 63 or 84 inches of width (plus selvage allowances). Differences such as these require a special loom set up for each airbag pattern or creates excess, wasted fabric (such as when a 21 inch airbag must be woven at 63 inches to fit on an 80-inch fabric). By varying the bias angle at which the airbag is woven, a single jacquard loom tie-up will accommodate virtually every airbag design.

In order to reduce waste and make effective use of a loom, a template or pattern of an airbag is first examined in relation to a template of the loom output. By inspection, it is possible for those of ordinary skill to orient the template of the airbag on the template of the loom so that the full width of the loom output (less selvage allowances) is used. If the longest dimension of the airbag is less than the width of the output of the loom, then the user may attempt to orient the airbag template so that two (or some other integral number of airbag templates) will fit properly across the loom output. Alternatively, a programmed computer can be used to optimize the orientation of the airbag pattern so that waste is minimized and the full width of the loom is used.

Furthermore, upon inflation, a bias-woven airbag contracts more strongly. When the airbag inflates, the woven, two-dimensional flat pattern becomes a three-dimensional chambered cushion that can provide impact protection. The airbag also shortens upon inflation, creating tension in the lengthwise direction that helps to restrain occupants of a vehicle during rollover. The greater the tension upon inflation, the greater the restraint provided to protect the occupants. A bias-woven airbag will shorten to a greater extent than a non-bias-woven airbag.

In order to increase productivity in airbag manufacture, increase contraction of an airbag upon inflation, and to have the airbag hold inflation medium for the requisite time for a side impact curtain airbag, the present method includes bias-weaving the airbag using the Milliken weave as described above.

While specific embodiments of the invention have been illustrated and described, it is to be understood that the invention is not limited thereto, since modifications may certainly be made and other embodiments of the principals of this invention will no doubt occur to those skilled in the art. Such modifications include, but are in no way limited to, the ability to produce reverse, mirror, or offset versions of the aforementioned two-pattern combinations within the inventive fabrics. Therefore, it is contemplated by the appended claims to cover any such modifications and other embodiments as incorporate the features of this invention which in the true spirit and scope of the claims hereto.

What is claimed is:

1. A method of making a side curtain airbag, said method comprising the steps of:

providing a side curtain airbag pattern having a longest straight side and a longest dimension; and weaving a side curtain airbag fabric having a warp with said longest straight side oriented in a bias direction with respect to said warp wherein said bias direction is at most 70°.

2. A method of making a side curtain airbag, said method comprising the steps of:

providing a side curtain airbag pattern having a longest straight side and a longest dimension; and weaving a side curtain airbag fabric having a warp with said longest straight side oriented in a bias direction with respect to said warp wherein said bias direction is selected so that plural airbags can be woven simultaneously.

3. The method as recited in claim 1, wherein said weaving step further comprises the step of weaving said side curtain airbag fabric to have at least two layers of fabric in certain discrete areas of said fabric and at least two discrete narrow areas of single fabric layer at discrete areas within said fabric, wherein said at least two discrete narrow areas of single fabric layer are each formed solely from a basket weave pattern of an even number of yarns, at most 12 yarns in width, wherein said at least two discrete narrow areas of single fabric layer are separated by a separator area of at least two layers of fabric, and wherein the lengths of each single fabric layer are from 4 to 8 yarns in length, wherein said at least two single fabric layer areas are seams through said fabric that run parallel to each other, and wherein said separator area of at least two layers of fabric comprises an even number of weft yarns.

4. The method as recited in claim 3, wherein said separator area of two layers of fabric comprises at most 12 weft yarns and at least 2 weft yarns.

5. The method as recited in claim 3, wherein said at least two single fabric layers are constructed solely from two-by-two basket weave patterns and said separator area of two layers of fabric comprises four weft yarns.

6. The method as recited in claim 1, wherein said weaving step further comprises the step of weaving said side curtain airbag fabric to have at least two layers of fabric in certain discrete areas of the fabric and at least two discrete narrow areas of single fabric layer at discrete areas within said fabric wherein said at least two narrow areas of single fabric layer are each formed solely from a basket weave pattern of an even number of yarns, at most 12 yarns in width, wherein said at least two areas of single fabric layers are separated by an area of at least two layers of fabric, wherein the lengths of each single layer is from 4 to 8 yarns in length, and wherein a at least a portion of one of said at lest tow discrete narrow areas of single fabric layer form at least one of a non-linear seam and seal.

7. The method as recited in claim 1, wherein said weaving step further comprises the step of weaving said side curtain airbag fabric to have at least two layers of fabric in certain discrete areas of the fabric and at least two discrete narrow areas of single fabric layer at discrete areas within said fabric, wherein said at least two narrow areas of single fabric layer are each formed solely from a basket weave pattern of an even number of yarns, at most 12 yarns in width, wherein said at least two areas of single fabric layers are separated by an area of at least two layers of fabric, wherein the lengths of each single layer is from 4 to 8 yarns in length, and wherein at least a portion of one of said at least two discrete narrow areas of single fabric layer form at least one of a non-linear seam and seal.

8. The method as recited in claim 1, wherein said weaving step further comprises the step of weaving said side curtain airbag fabric to have at least two layers of fabric in certain discrete areas of the fabric and at least two discrete narrow areas of single fabric layer at discrete areas within said fabric, wherein said at least two narrow areas of single fabric layer are each formed solely from a basket weave pattern of an even number of yarns, at most 12 yarns in width, wherein said at least two areas of single fabric layers are separated by an area of at least two layers of fabric, wherein the lengths of each single layer is from 4 to 8 yarns in length, and wherein said fabric has three different types of patterns, the first pattern is a repeated plain weave pattern throughout at least two layers of fabric which must always initiate at a location in the warp direction of 4X+1, with X representing the number of pick arrangement a weave diagram, and at a location in the fill direction of 4X+1, pick arrangement including the specific two layer plain-weave-signifying-block begins at the block four spaces below it in both directions, the second pattern is an "up-down" basket weave pattern wherein an empty block must exist and always initiate the basket-weave pattern at a location in the warp direction of 4X+1, with X representing the number of repeating pick arrangements within the diagram, and at a location in the fill direction of 4X+1, when a single layer fabric is desired, the pattern including the pertinent signifying "up-down" block includes an empty block within the basket-weave pick arrangement in both the warp and fill directions four spaces below it, the third pattern is basically a "down-up" basket weave pattern to a single fabric layer and must always initiate at a location in the warp direction of 4X+1 and fill of 4X+3, or warp of 4X+3 and fill of 4X+1, when a seam is desired, such a specific arrangement of differing "up-down" basket weave and "down-up" basket weave pattern is necessary to effectuate the continuous and repeated weave construction wherein no more than three floats or empty blocks are present simultaneously within the target fabric structure.

9. The method as recited in claim 1, wherein said weaving step further comprises the step of weaving said side curtain airbag fabric to have at least two layers of fabric in certain discrete areas of the fabric and at least two discrete narrow areas of single fabric layer at discrete areas within said fabric, wherein said at least two narrow areas of single fabric layer are each formed solely from a basket weave pattern of an even number of yarns, at most 12 yarns in width, wherein said at least two areas of single fabric layers are separated by an area of at least two layers of fabric, wherein the lengths of each single layer is from 4 to 8 yarns in length, and wherein weft yarns are present in each of the fabric layer areas over and under which individual warp yarns have been woven, the at least two layer fabric areas are woven in plain weave patterns, the single fabric layer areas are woven in basket weave patterns, four weft yarns each are configured through each repeating basket weave pattern, however, anywhere from two to twelve weft yarns may be utilized within the single layer fabric areas or, the intermediate two layer fabric areas comprise each only four weft yarns within plain weave patterns, the number of such intermediate weft yarns between the single layer fabric areas must be in multiples of two to provide the maximum pressure bearing benefits within the two seams with the at least two layer fabric areas.

10. A side curtain airbag made by a process comprising the steps of:

providing a side curtain airbag pattern having a longest straight side and a longest dimension; and weaving a side curtain airbag fabric according to said side curtain airbag pattern having a warp with said longest straight side of said side curtain airbag pattern oriented in a bias direction with respect to said warp ranging between 20° and 70°, wherein said weaving step further comprises the step of weaving said side curtain airbag fabric to have at least two layers of fabric in certain discrete areas of said fabric and at least two discrete narrow areas of single fabric layer at discrete areas within said fabric, wherein said at least two discrete narrow areas of single fabric layer are each formed solely from a basket weave pattern of an even number of yarns, at most 12 yarns in width, wherein said at least two discrete narrow areas of single fabric layer are separated by a separator area of at least two layers of fabric, and wherein the lengths of each single fabric layer are from 4 to 8 yarns in length, wherein said at least two single fabric layer areas are seams through said fabric that run parallel to each other, and wherein said separator area of at least two layers of fabric comprises an even number of weft yarns.

11. A side curtain airbag made by a process comprising the steps of:

providing a side curtain airbag pattern having a longest straight side and a longest dimension; and weaving a side curtain airbag fabric according to said side curtain airbag pattern having a warp with said longest straight side of said side curtain airbag pattern oriented in a bias direction with respect to said warp ranging between 20° and 70°, wherein said weaving step further comprises the step of weaving said side curtain airbag fabric to have at least two layers of fabric in certain discrete areas of the fabric and at least two discrete narrow areas of single fabric layer at discrete areas within said fabric wherein said at least two narrow areas of single fabric layer are each formed solely from a basket weave pattern of an even number of yarns, at most 12 yarns in width, wherein said at least two areas of single fabric layers are separated by an area of at least two layers of fabric, wherein the lengths of each single layer is from 4 to 8 yarns in length, and wherein a weave diagram having rows and columns of filled and unfilled blocks for the fabric does not exhibit more than three consecutive unfilled blocks in any row or column.

12. A side curtain airbag made by a process comprising the steps of:

providing a side curtain airbag pattern having a longest straight side and a longest dimension; and weaving a side curtain airbag fabric according to said side curtain airbag pattern having a warp with said longest straight side of said side curtain airbag pattern oriented in a bias direction with respect to said warp ranging between 20° and 70°, wherein said weaving step further comprises the step of weaving said side curtain airbag fabric to have at least two layers of fabric in certain discrete areas of the fabric and at least two discrete narrow areas of single fabric layer at discrete areas within said fabric, wherein said at least two narrow areas of single fabric layer are each formed solely from a basket weave pattern of an even number of yarns, at most 12 yarns in width, wherein said at least two areas of single fabric layers are separated by an area of at least two layers of fabric, wherein the lengths of each single layer is from 4 to 8 yarns in length, and wherein at least a portion of one of said at least two discrete narrow areas of single fabric layer form at least one of a non-linear seam and seal.

13. A side curtain airbag made by a process comprising the steps of:

providing a side curtain airbag pattern having a longest straight side and a longest dimension; and weaving a side curtain airbag fabric according to said side curtain airbag pattern having a warp with said longest straight side of said side curtain airbag pattern oriented in a bias direction with respect to said warp ranging between 20° and 70° The method as recited in claim 1, wherein said weaving step further comprises the step of weaving said side curtain airbag fabric to have at least two layers of fabric in certain discrete areas of the fabric and at least two discrete narrow areas of single fabric layer at discrete areas within said fabric, wherein said at least two narrow areas of single fabric layer are each formed solely from a basket weave pattern of an even number of yarns, at most 12 yarns in width, wherein said at least two areas of single fabric layers are separated by an area of at least two layers of fabric, wherein the lengths of each single layer is from 4 to 8 yarns in length, and wherein said fabric has three different types of patterns, the first pattern is a repeated plain weave pattern throughout at least two layers of fabric which must always initiate at a location in the warp direction of 4X+1, with X representing the number of pick arrangement a weave diagram, and at a location in the fill direction of 4X+1, pick arrangement including the specific two layer plain-weave-signifying-block begins at the block four spaces below it in both directions, the second pattern is an "up-down" basket weave pattern wherein an empty block must exist and always initiate the basket-weave pattern at a location in the warp direction of 4X+1, with X representing the number of repeating pick arrangements within the diagram, and at a location in the fill direction of 4X+1, when a single layer fabric is desired, the pattern including the pertinent signifying "up-down" block includes an empty block within the basket-weave pick arrangement in both the warp and fill directions four spaces below it, the third pattern is basically a "down-up" basket weave pattern to a single fabric layer and must always initiate at a location in the warp direction of 4X+1 and fill of 4X+3, or warp of 4X+3 and fill of 4X1, when a seam is desired, such a specific arrangement of differing "up-down" basket weave and "down-up" basket weave pattern is necessary to effectuate the continuous and repeated weave construction wherein no more than three floats or empty blocks are present simultaneously within the target fabric structure.

* * * * *

UNITED STATES PATENT AND TRADEMARK OFFICE

CERTIFICATE OF CORRECTION

PATENT NO. : 6,978,808 B2
APPLICATION NO. : 10/621713
DATED : December 27, 2005
INVENTOR(S) : Walsh et al.

It is certified that error appears in the above-identified patent and that said Letters Patent is hereby corrected as shown below:

In Column 7, beginning with line 19 after "wherein a", please delete "at least a portion of one of said at lest tow discrete narrow areas of single fabric layer form at least one of a non-linear seam and seal." and insert --weave diagram having rows and columns of filled and unfilled blocks for the fabric does not exhibit more than three consecutive unfilled blocks in any row or column.--

In Column 9, line 44 after "between 20* and 70*", please delete "The method as recited in claim 1,"

In Column 10, line 35 after "and fill of", please delete "4X1" and insert --4X+1--

Signed and Sealed this

Seventh Day of April, 2009

JOHN DOLL
*Acting Director of the United States Patent and Trademark Office*